US010006692B2

(12) United States Patent
Erol et al.

(10) Patent No.: US 10,006,692 B2
(45) Date of Patent: Jun. 26, 2018

(54) SHELF ASSEMBLY AND REFRIGERATION APPLIANCE HAVING THE SAME

(71) Applicant: ARCELIK ANONIM SIRKETI, Istanbul (TR)

(72) Inventors: Semih Erol, Istanbul (TR); Ozgun Atac Gultekin, Istanbul (TR); Tayfun Ersoz, Istanbul (TR); Cagdas Fidan, Istanbul (TR); Erhan Kahraman, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 0 days. days.

(21) Appl. No.: 15/523,933

(22) PCT Filed: Nov. 3, 2014

(86) PCT No.: PCT/EP2014/073546
§ 371 (c)(1),
(2) Date: May 2, 2017

(87) PCT Pub. No.: WO2016/070894
PCT Pub. Date: May 12, 2016

(65) Prior Publication Data

US 2017/0321957 A1 Nov. 9, 2017

(51) Int. Cl.
*F25D 23/00* (2006.01)
*F25D 23/06* (2006.01)
(Continued)

(52) U.S. Cl.
CPC ..... *F25D 23/067* (2013.01); *F25D 25/02* (2013.01); *F25D 25/024* (2013.01); *F25D 23/00* (2013.01);
(Continued)

(58) Field of Classification Search
CPC ..... F25D 23/007; F25D 225/02; F25D 2325/021; A47B 57/06; A47B 57/20; A47B 57/30
See application file for complete search history.

(56) References Cited

U.S. PATENT DOCUMENTS 3,316,044 A * 4/1967 Carbary ..... A47B 57/06 108/106
5,273,354 A * 12/1993 Herrmann ..... A47B 96/025 312/408
(Continued)

FOREIGN PATENT DOCUMENTS

DE 19527731 A1 1/1997
JP 2004286411 A 10/2004
(Continued)

OTHER PUBLICATIONS

International search report and written opinion, dated Nov. 3, 2015, of corresponding International Application No. PCT/EP2014/073546; 13 pgs.

*Primary Examiner* — Daniel J Rohrhoff
(74) *Attorney, Agent, or Firm* — Kilpatrick Townsend & Stockton LLP

(57) ABSTRACT

The present invention relates to a shelf assembly for use in a refrigeration appliance comprising a compartment for refrigerating food. The shelf assembly comprises a releasable shelf for supporting the food. The shelf assembly of the present invention comprises at least one retainer which is detachably mountable to either one of the side walls of the compartment, at least one counterpart retainer which is adjustably mountable at different heights onto either one of the lateral sides of the shelf. The counterpart retainer slidably engages with the corresponding retainer so as to reciprocate through a predetermined distance in the direction which is perpendicular to the side walls of the compartment.

15 Claims, 8 Drawing Sheets

Figure 1:
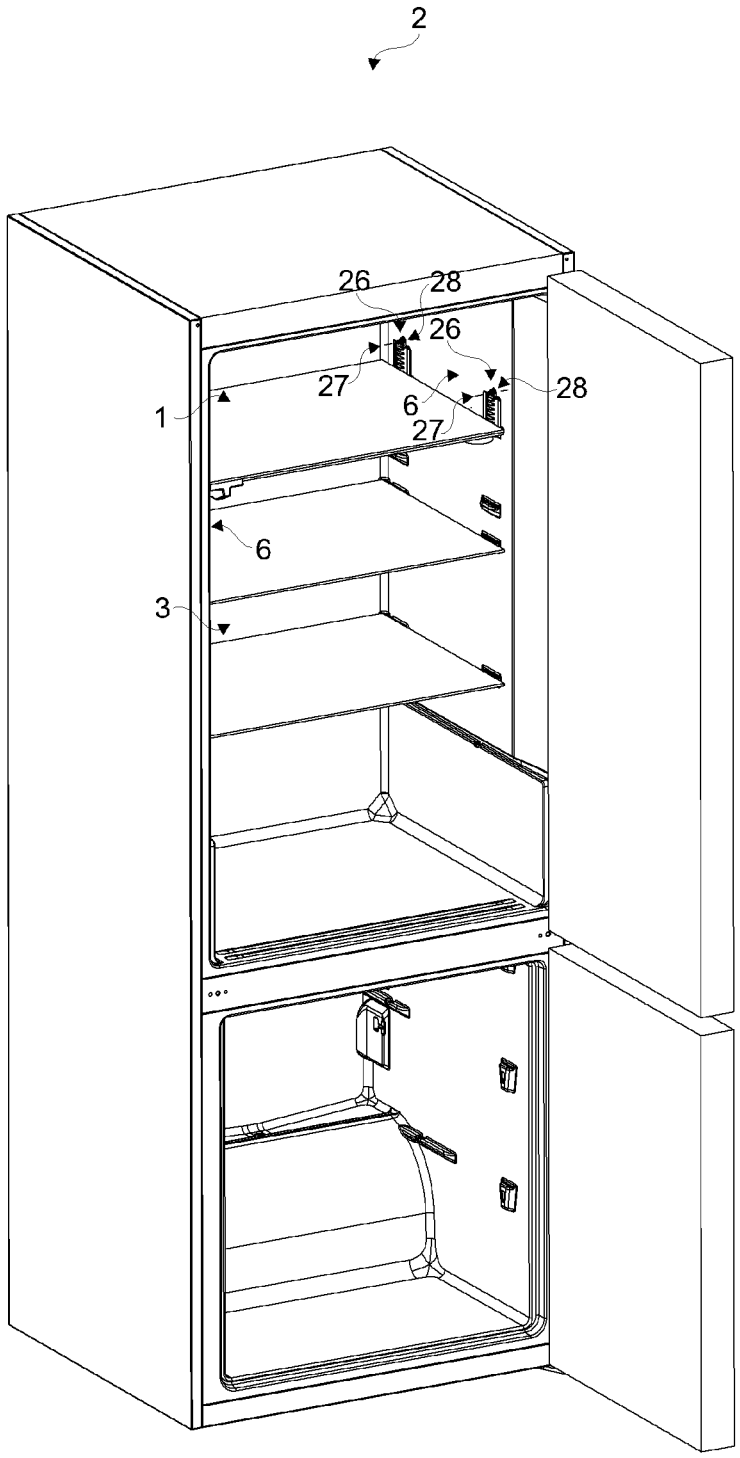

(51) Int. Cl.
*F25D 25/02* (2006.01)
*F25D 25/00* (2006.01)

(52) U.S. Cl.
CPC ..... *F25D 25/00* (2013.01); *F25D 2325/021* (2013.01)

(56) References Cited

U.S. PATENT DOCUMENTS

| | | | | |
|---|---|---|---|---|
| 9,243,839 | B2 * | 1/2016 | Kim | F25D 25/02 |
| 2004/0174107 | A1 * | 9/2004 | O'Halloran | A47B 96/063 312/404 |
| 2005/0062380 | A1 * | 3/2005 | Park | A47B 57/06 312/408 |
| 2009/0255292 | A1 * | 10/2009 | Benz | A47B 57/06 62/378 |
| 2010/0064721 | A1 * | 3/2010 | Shin | F25D 25/02 62/465 |
| 2011/0290807 | A1 * | 12/2011 | Calvillo | F25D 25/02 220/592.02 |
| 2016/0047594 | A1 * | 2/2016 | Choo | F25D 25/02 312/404 |

FOREIGN PATENT DOCUMENTS

| | | | |
|---|---|---|---|
| WO | 2013041679 | A2 | 3/2013 |
| WO | 2014083463 | A1 | 6/2014 |

* cited by examiner

SHELF ASSEMBLY AND REFRIGERATION APPLIANCE HAVING THE SAME

RELATED APPLICATIONS

This application is a U.S. National Phase of International Application No. PCT/EP2014/073546, filed Nov. 3, 2014, the entire disclosure of which is incorporated by reference herein.

The present invention relates to a refrigeration appliance, in particular a domestic refrigerator which has a releasable shelf.

In general, the items to be refrigerated have different sizes and shapes. For more efficiently using the volume of the refrigeration compartment, the refrigeration compartment of a prior art domestic refrigerator is usually provided with a releasable shelf and a plurality of vertically spaced supports for releasably receiving the shelf at different levels. Thereby, the user is enabled to rearrange the shelf at a desired level within the refrigeration compartment in accordance with the items to be currently refrigerated. Thus, the releasable shelves generally improve the convenience for the users. In the prior art domestic refrigerator, the vertically spaced supports are usually provided as elongated depressions which are formed into the opposing side walls of the refrigerating compartment.

A problem with the prior art domestic refrigerator is that the side walls of the compartment, in particular the depressions formed into the inner lining thereof have production-dependent non-uniformities. These non-uniformities generally influence the operation performance of the releasable shelves. In the event of relatively large non-uniformities, the releasable shelves either completely fall out or get completely stuck. In such cases, the domestic refrigerator becomes junk and the overall production costs increase. In the event of relatively small non-uniformities, the releasable shelves engage either loosely or tightly. In case of a loose engagement, the shelf starts rattling and produces disturbing noises. In case of a tight engagement, the shelf starts squeaking. In such cases, the operation performance of the shelf is degraded. Thus, a consumer satisfaction easily decreases because of the inferior quality and the customer complaints increases.

An objective of the present invention is to provide a shelf assembly and a refrigeration appliance having the same which overcomes the aforementioned drawbacks of the prior art in a cost effective way and which enables a smooth operation and an improved usability of the releasable shelf.

This objective has been achieved by the shelf assembly as defined in claim 1 and the refrigeration appliance as defined in claim 12. Further achievements are attained by the subject-matters respectively defined in the dependent claims.

The shelf assembly of the present invention comprises one or more than one retainer which is detachably mountable to either one of the side walls of the compartment. The shelf assembly of the present invention further comprises one or more than one counterpart retainer which is adjustably mountable at different heights onto either one of the lateral sides of the shelf. The counterpart retainer is slidably engageable with the corresponding retainer so as to reciprocate through a predetermined distance in the direction which is perpendicular to the side walls of the compartment. The shelf assembly of the present invention further comprises one or more than one spring element which biases the counterpart retainer away from the corresponding retainer.

In an embodiment, the retainer has a linear bearing which slidably supports a matching guide of the counterpart retainer. Thereby, the counterpart retainer can move away from the retainer or move towards the retainer during the assembly process and compensate for the aforementioned non-uniformities.

In another embodiment, each spring element has a coil spring which abuts against the retainer and the corresponding counterpart retainer respectively. Thereby, the counterpart retainer and the retainer are elastically biased against each other.

In another embodiment, each retainer is fixed to the side wall, in particular onto the inner lining of the compartment by a screw.

In another embodiment, each counterpart retainer has a vertically slidable gear rack and a round gear rotatable about the vertical axis. The round gear has at least one protrusion which can be manually locked with or unlocked from the gear rack at different heights.

In another embodiment, the shelf has a locking/unlocking means for manually locking the round gear with the gear rack or unlocking the round gear from the gear rack at different heights. In a version of this embodiment the locking/unlocking means has movable belt which grasps the round gears. The user can rotate the belt by a slider which is fixed to the belt.

In another embodiment, the shelf includes a plate and a frame which supports the plate. In a version of this embodiment, the plate is made from glass.

The present invention also provides a refrigeration appliance which has the shelf assembly inside its refrigeration compartment.

In another embodiment, the shelf assembly inside the compartment of the refrigeration appliance includes two retainers and two counterpart retainers which are slidably engaged and disposed between one lateral side of the shelf and the corresponding side wall. In this embodiment, two spring elements respectively bias the counterpart retainers away from the retainers. In this embodiment, two additional counterpart retainers are disposed between the other lateral side of the shelf and the corresponding side wall. These additional counterpart retainers are directly and detachably mounted to the side wall without being slidably engaged with any retainer.

In a version of this embodiment, the two additional counterpart retainers are mounted to the side wall by screws respectively.

With the present invention, particularly by virtue of the resilient sliding engagement of the retainer pair, the shelf can be smoothly mounted and released despite the presence of any non-uniformity in the side walls of the refrigeration compartment. Thereby, the shelf is also prevented from rattling and producing disturbing noises as it is manipulated by the user. Also, the smooth operation is maintained even when the inner lining undergoes deformations which are likely to be caused during the normal use of the refrigeration compartment. With the present invention, the adverse effects of the aforementioned non-uniformities have been eliminated or reduced as much as possible. With the present invention, particularly by virtue of the height adjustable retainer, the shelf can be smoothly released and mounted at different heights into the compartment in accordance with the current requirement of the user. Thereby, the customer satisfaction can be increased.

Figure 2:
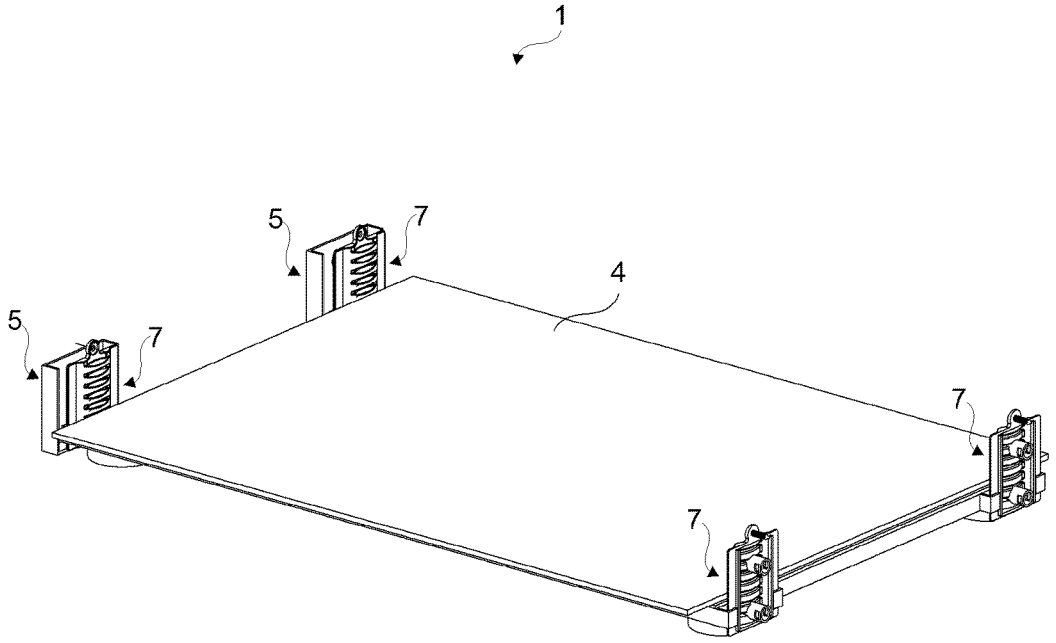
Figure 3:
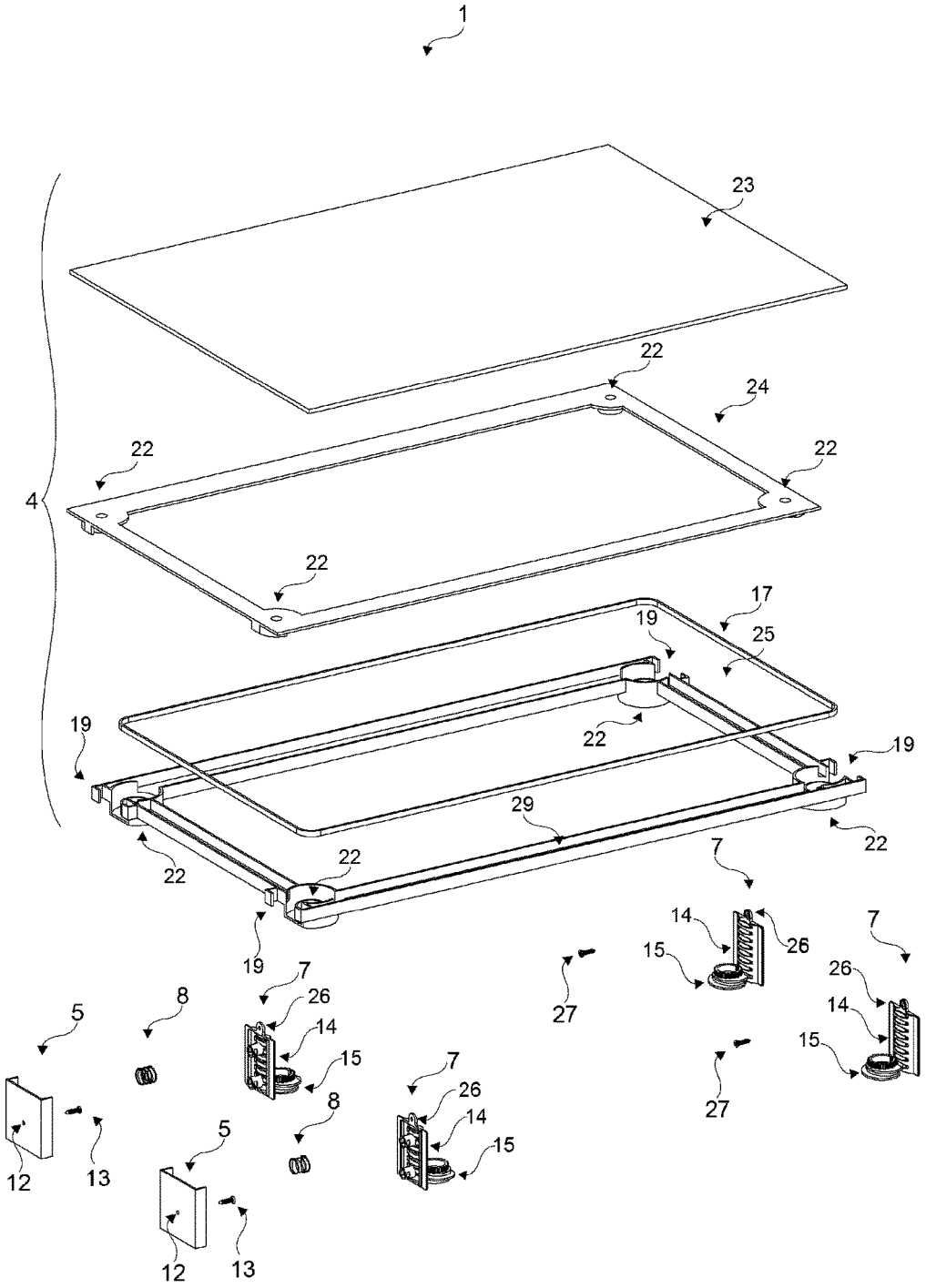
Figure 4:
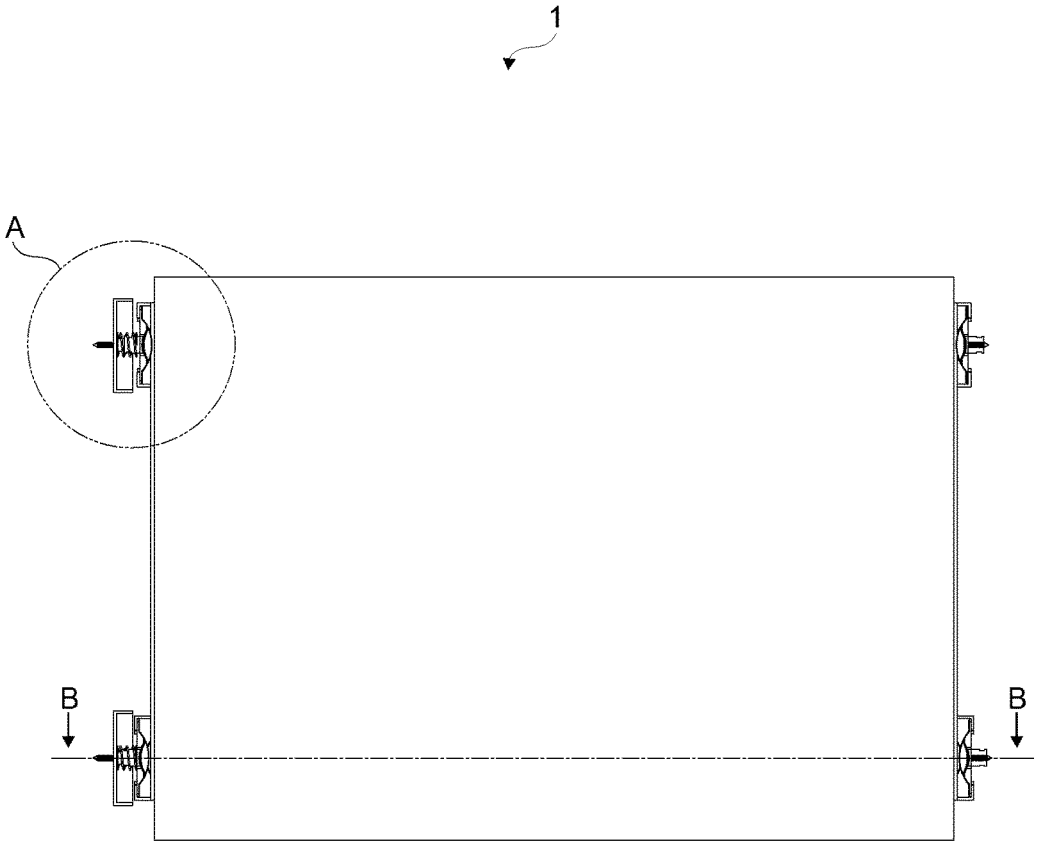
Figure 5:
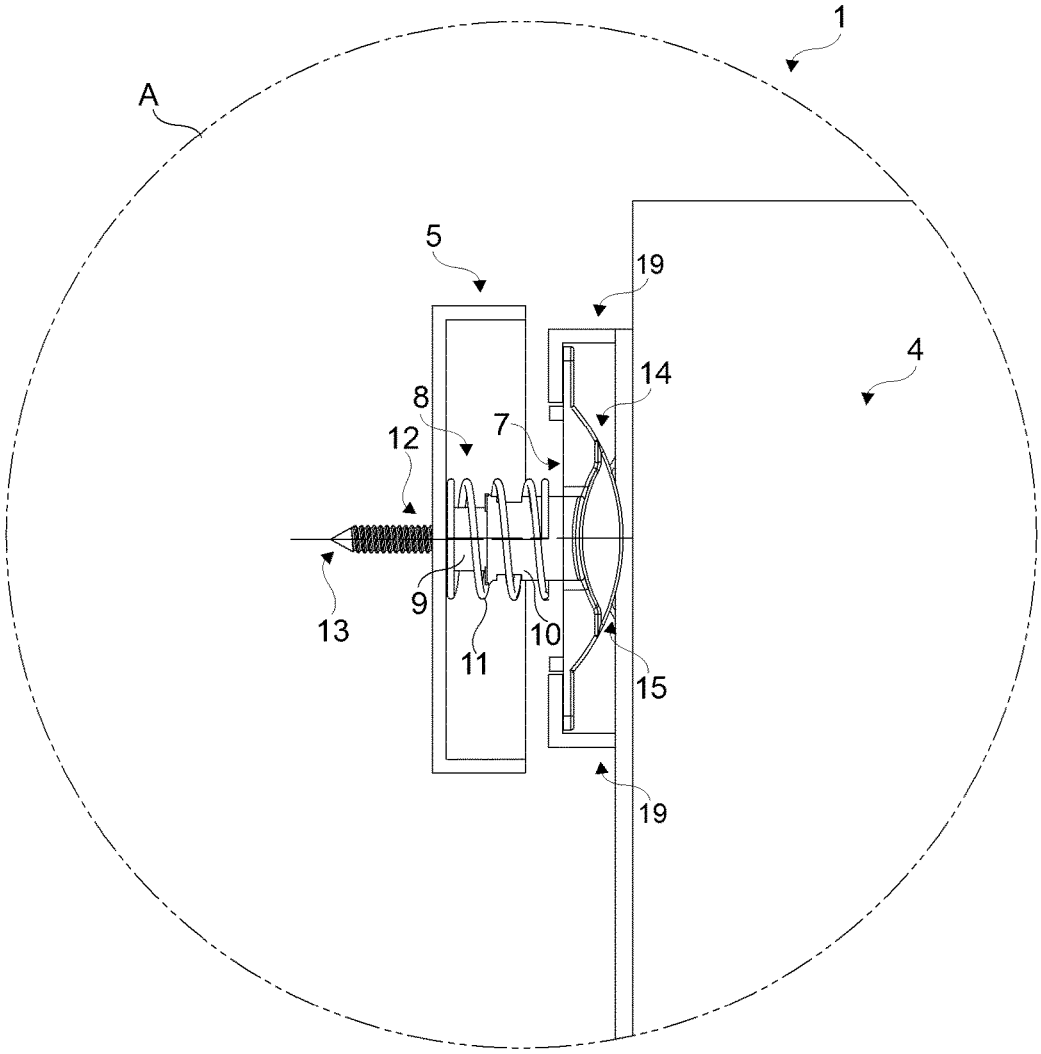
Figure 6:
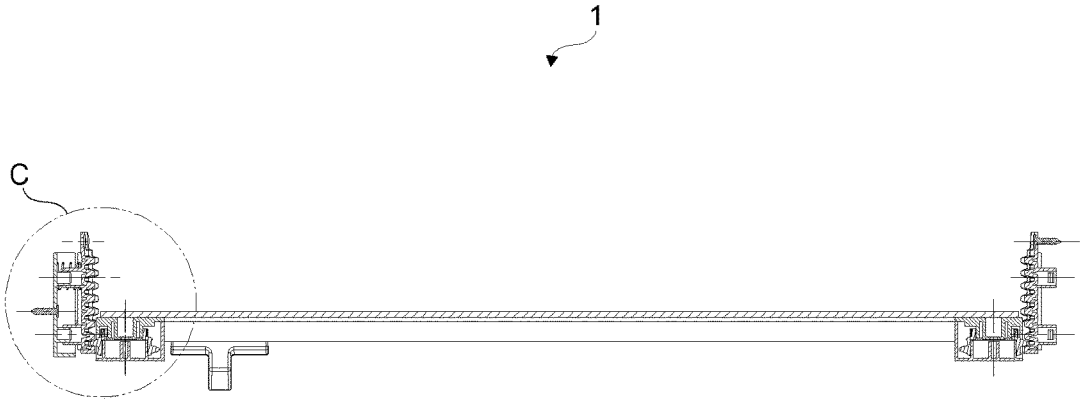
Figure 7:
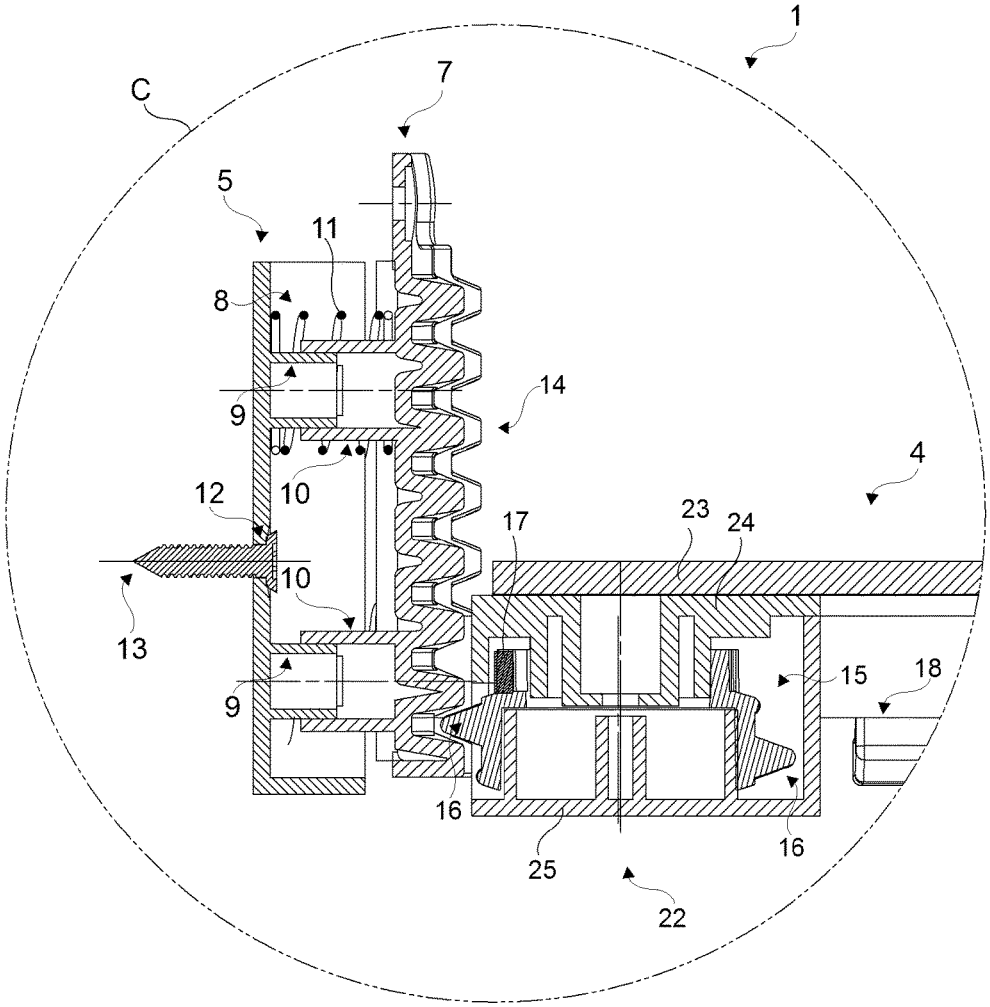
Figure 8:
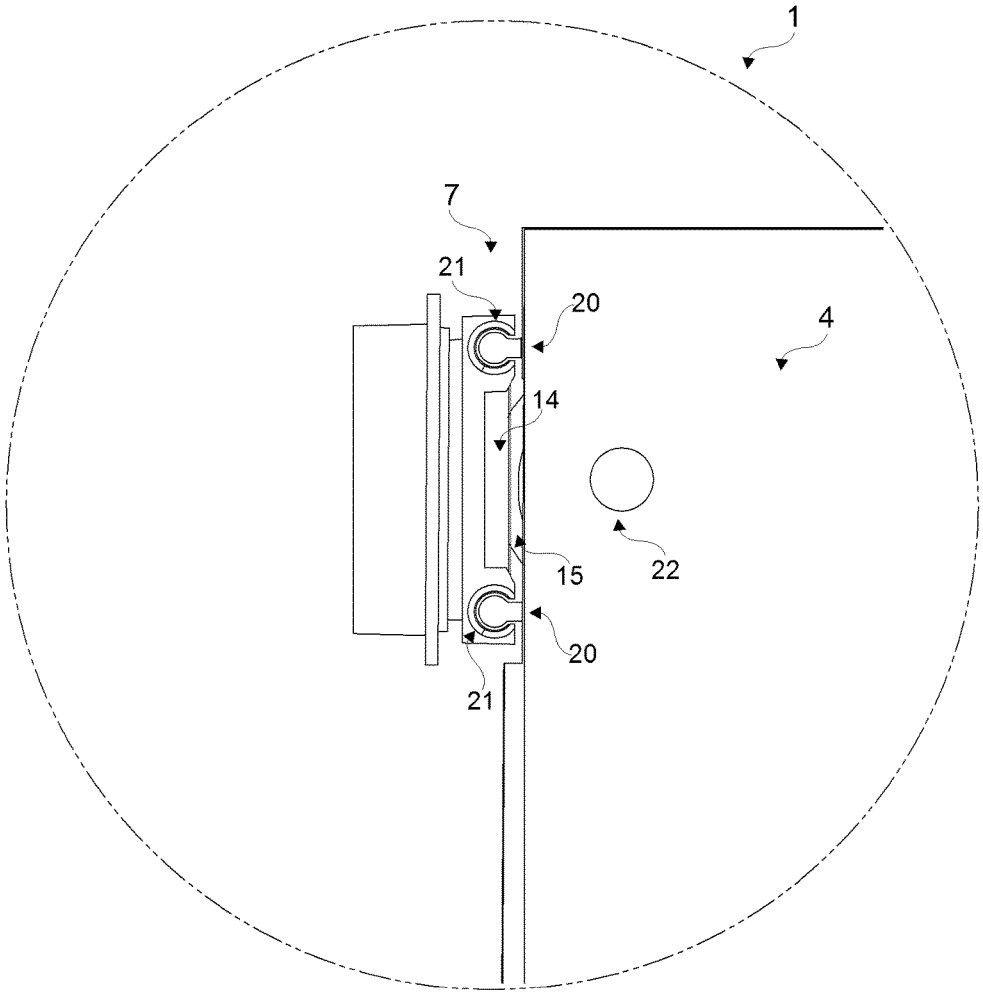

Additional advantages of the shelf assembly according to the present invention and the refrigeration appliance according to the present invention will now become apparent with the detailed description of the embodiments with reference to the accompanying drawings in which:

FIG. 1—is a schematic perspective view of a domestic refrigerator which has a shelf assembly according to an embodiment of the present invention, FIG. 2—is a schematic perspective view of the shelf assembly according to an embodiment of the present invention, prior to mounting into the compartment of the domestic refrigerator, FIG. 3—is a schematic perspective exploded view of the shelf assembly according to an embodiment of the present invention, FIG. 4—is a schematic top view of the shelf assembly according to an embodiment of the present invention, FIG. 5—is a schematic enlarged view of the detail A of FIG. 4, FIG. 6—is a schematic sectional view of the shelf assembly according to an embodiment of the present invention, taken along the line B-B of FIG. 4, FIG. 7—is a schematic enlarged view of the detail C of FIG. 6, FIG. 8—is a schematic partial enlarged view of a shelf assembly according to another embodiment of the present invention.

The reference signs appearing on the drawings relate to the following technical features.

1. Assembly
2. Refrigeration appliance
3. Compartment
4. Shelf
5. Retainer
6. Wall
7. Retainer
8. Spring element
9. Bearing
10. Guide
11. Coil Spring
12. Hole
13. Screw
14. Rack
15. Gear
16. Protrusion
17. Belt
18. locking/unlocking means
19. Bracket
20. Rail
21. Bearing
22. Bearing
23. Plate
24. Frame
25. Frame
26. Hole
27. Screw
28. Hole
29. Groove The shelf assembly (1) is suitable for use in a refrigeration appliance (2), in particular a domestic refrigerator which comprises a compartment (3) for refrigerating food (FIGS. 1 to 8). The shelf assembly (1) comprises a releasable shelf (4) for supporting the food.

The shelf assembly (1) of the present invention further comprises one or more than one retainer (5) which is detachably mountable to either one of the side walls (6) of the compartment (3), one or more than one counterpart retainer (7) which is adjustably mountable at different heights on either one of the lateral sides of the shelf (4). The counterpart retainer (7) is slidably engageable with the corresponding retainer (5) so as to reciprocate through a predetermined distance in the direction which is perpendicular to the side walls (6) of the compartment (3). The shelf assembly (1) of the present invention further comprises one or more than one spring element (8) for biasing the counterpart retainer (7) away from the corresponding retainer (5).

In an embodiment, the shelf assembly (1) has at least one bearing (9) which is formed on each retainer (5) and at least one guide (10) which is formed on the corresponding counterpart retainer (7). The bearing (9) of the retainer (5) slidably engages with the guide (10) of the corresponding counterpart retainer (7). In a version of this embodiment, the guide (10) has a tubular shape whereas the bearing (9) has a cylindrical shape. The cylindrical shaped bearing (9) slides inside the tubular shaped guide (10).

In another embodiment, each spring element (8) has a coil spring (11) which is sleeved both around the bearing (9) of the retainer (5) and the guide (10) of the corresponding counterpart retainer (7). In this embodiment, the opposing ends of the coil spring (11) abut against the retainer (5) and the corresponding counterpart retainer (7) respectively.

In another embodiment, the retainer (5) has a screw hole (12) for receiving a fixing screw (13). The fixing screw (13) is mountable to a counterpart screw hole (not shown) which is formed on the corresponding side wall (6) of the compartment (3).

In another embodiment, each counterpart retainer (7) has a gear rack (14) and a round gear (15). The round gear (15) has at least one protrusion (16) which can be locked with or unlocked from the gear rack (14) at different heights. The gear rack (14) is slidably mountable to either one of the lateral sides of the shelf (4) in the vertical direction. The round gear (15) is rotatably mountable to either one of the lateral sides of shelf (4) about the vertical direction. In this embodiment, each counterpart retainer (7) slidably engages with the corresponding retainer (5) via its gear rack (14). In a version of this embodiment, the guide (10) of the counterpart retainer (7) is formed on the gear rack (14).

In another embodiment, the shelf (4) has a manual locking/unlocking means (18) for locking the protrusion (16) with the gear rack (14) or unlocking the protrusion (16) from the gear rack (14) at different heights respectively by way of manually rotating a belt (17) which grips each round gear (15). In a version of this embodiment, the belt (17) is movably arranged within a groove (29) which is formed into the shelf (4) (FIGS. 1 to 8).

In another embodiment, each gear rack (14) is slidably mountable in the vertical direction into a corresponding bracket (19) which is formed on the shelf (4) (FIGS. 1 to 7).

In an alternative embodiment, each gear rack (14) has at least one bearing (21) which is slidably mountable in the vertical direction to a corresponding guide rail (20) which is formed on the shelf (4) (FIG. 9).

In another embodiment, the hub of each round gear (15) is rotatably supported by a bearing (22) which is formed into the shelf (4) (FIGS. 1 to 8).

In another embodiment, each round gear (15) has two protrusions (16) which extend in opposite directions.

In another embodiment, the shelf (4) includes a plate (23), an upper frame (24) for supporting the plate (23) and a lower frame (25) which engages with the upper frame (24). In a version of this embodiment the plate (23) is made of a transparent material such as glass.

The present invention also provides a refrigeration appliance (2) which has the shelf assembly (1) inside its refrigeration compartment (3).

In another embodiment, the shelf assembly (1) inside the compartment (3) of the refrigeration appliance (1) comprises two retainers (5) and two counterpart retainers (7) which are slidably engaged and disposed between one lateral side of the shelf (4) and the corresponding side wall (6). In this embodiment, two spring elements (8) respectively bias the counterpart retainers (7) away from the retainers (5). In this embodiment, two additional counterpart retainers (7) are disposed between the other lateral side of the shelf (4) and the corresponding side wall (6). These additional counterpart retainers (7) are detachably and directly mounted to the side wall (6) without being slidably engaged with any additional retainers (5) (FIGS. 1 to 8). In another alternative embodiment, the two additional counterpart retainers (7) are also slidably engaged with two additional retainers (5) (not shown).

In another embodiment, each of the two additional counterpart retainers (7) has a screw hole (26) for receiving a corresponding fixing screw (27). The fixing screws (27) are mounted to counterpart screw holes (28) which are formed on the corresponding side wall (6) of the compartment (3).

In another embodiment, the refrigeration appliance (2) is provided in form of a domestic refrigerator.

With the present invention, the user can smoothly mount and release the shelf (4) despite the presence of any production dependent non-uniformity in the side walls (6) of the refrigeration compartment (3). With the present invention, the user can also smoothly release and remount the shelf (4) at different heights into the compartment (3). Thereby, the user can more efficiently utilize the interior of the compartment (3). With the present invention, the customer satisfaction can be increased. In addition, with the present invention the occurrence of production wastes can be reduced as much as possible and the overall production costs can be reduced.

The invention claimed is:

1. A shelf assembly for use in a refrigeration appliance with a compartment for refrigerating food, the shelf assembly comprising a releasable shelf for supporting the food, characterized in that one or more than one retainer which is detachably mountable to either one of the side walls of the compartment, one or more than one counterpart retainer which is adjustably mountable at different heights on either one of the lateral sides of the shelf, wherein the counterpart retainer is slidably engageable with the corresponding retainer so as to reciprocate through a predetermined distance in the direction which is perpendicular to the side walls of the compartment and one or more than one spring element for biasing the counterpart retainer away from the corresponding retainer in the direction which is perpendicular to the side walls of the compartment.

2. The shelf assembly according to claim 1, characterized in that one or more than one bearing which is formed on each retainer and one or more than one guide which is formed on the corresponding counterpart retainer, wherein the bearing of the retainer is adapted to slidably engage with the guide of the corresponding counterpart retainer.

3. The shelf assembly according to claim 2, characterized in that each spring element comprising a coil spring which is sleeved both around the bearing of the retainer and the guide of the corresponding counterpart retainer, wherein the opposing ends of the coil spring abut against the retainer and the corresponding counterpart retainer respectively.

4. The shelf assembly according to claim 2, characterized in that the one or more than one bearing is oriented in the direction which is perpendicular to the side walls of the compartment and the one or more than one guide is oriented in the direction which is perpendicular to the side walls of the compartment.

5. The shelf assembly according to claim 1, characterized in that the retainer has a screw hole for receiving a fixing screw which is mountable to a counterpart screw hole which is formed on the corresponding side wall of the compartment.

6. The shelf assembly according to claim 1, characterized in that each counterpart retainer comprising a gear rack and a round gear which has at least one protrusion which is adapted to lock with or unlock from the gear rack at said different heights, wherein the gear rack is slidably mountable to either one of the lateral sides of the shelf in the vertical direction, wherein the round gear is rotatably mountable to either one of the lateral sides of shelf about the vertical direction and wherein each counterpart retainer is further adapted to slidably engage with the corresponding retainer via its gear rack.

7. The shelf assembly according to claim 6, characterized in that the shelf comprising a belt which is adapted to grasp each round gear and a manual locking/unlocking means for manually rotating the belt so as to lock the protrusion with the gear rack or unlock the protrusion from the gear rack at different heights respectively.

8. The shelf assembly according to claim 6, characterized in that one or more than one bracket which is formed on the shelf, wherein the gear rack is slidably mountable into the corresponding bracket.

9. The shelf assembly according to claim 6, characterized in that one or more than one guide rail which is formed on the shelf and the gear rack has one or more than one bearing which is slidably mountable to the corresponding guide rail in the vertical direction.

10. The shelf assembly according to claim 6, characterized in that one or more than one bearing formed into the shelf for rotatably supporting the hub of the round gear.

11. The shelf assembly according to claim 6, characterized in that each round gear has two protrusions which extend in opposite directions.

12. The shelf assembly according to claim 1, characterized in that the shelf comprising a glass plate, an upper frame which is adapted to support the glass plate and a lower frame which is adapted to engage with the upper frame.

13. A refrigeration appliance comprising a compartment for refrigerating food and the shelf assembly as defined in claim 1.

14. The refrigeration appliance according to claim 13, characterized in that two retainers which are detachably mounted to one of the side walls of the compartment, two counterpart retainers which are height adjustably mounted to the corresponding lateral side of the shelf, wherein each counterpart retainer is slidably engaged with the corresponding retainer so as to reciprocate through said predetermined distance in the direction which is perpendicular to the side walls of the compartment, two spring elements which are respectively arranged to bias the two counterpart retainers away from the corresponding two retainers, and two additional counterpart retainers which are height adjustably mounted to the other lateral side of the shelf, wherein the two additional counterpart retainers are directly and detachably mounted the other one of the side walls of the compartment.

15. The refrigeration appliance according to claim 14, characterized in that each of the two additional counterpart retainers has a screw hole for receiving a corresponding fixing screw which is mounted to a counterpart screw hole formed on the corresponding side wall of the compartment.

* * * * *